US009969141B2

(12) United States Patent
Stückle et al.

(10) Patent No.: US 9,969,141 B2
(45) Date of Patent: May 15, 2018

(54) MACHINE PRESS

(71) Applicant: HOERBIGER AUTOMATISIERUNGSTECHNIK HOLDING GMBH, Altenstadt (DE)

(72) Inventors: Andreas Stückle, Stuttgart (DE); Jochen Schaible, Altensteig (DE); Shankar Deepak Srinivasan, Berlin (DE); Simon Mösslang, Warthausen (DE); Martin Trittler, Stuttgart (DE)

(73) Assignee: HOERBIGER AUTOMATISIERUNGSTECHNIK HOLDING GMBH, Altenstadt (DE)

( * ) Notice: Subject to any disclaimer, the term of this patent is extended or adjusted under 35 U.S.C. 154(b) by 0 days. days.

(21) Appl. No.: 15/289,389

(22) Filed: Oct. 10, 2016

(65) Prior Publication Data

US 2017/0021583 A1 Jan. 26, 2017

Related U.S. Application Data

(63) Continuation of application No. PCT/EP2015/000744, filed on Apr. 9, 2015.

(30) Foreign Application Priority Data

Apr. 11, 2014 (DE) ..... 10 2014 005 352

(51) Int. Cl.
*B30B 15/16* (2006.01)
*B30B 1/32* (2006.01)

(52) U.S. Cl.
CPC ..... *B30B 15/163* (2013.01); *B30B 1/32* (2013.01); *B30B 15/161* (2013.01);
(Continued)

(58) Field of Classification Search
CPC ..... B30B 15/16; B30B 15/161; B30B 15/162; B30B 15/22; B30B 15/32;
(Continued)

(56) References Cited

U.S. PATENT DOCUMENTS 3,691,946 A * 9/1972 Ando ..... B30B 15/16 100/269.05
5,860,588 A * 1/1999 Anchor ..... B65D 5/067 229/125.42

(Continued)

FOREIGN PATENT DOCUMENTS

AT 8633 U1 10/2006
DE 10 2009 052 531 A1 5/2011
DE 10 2012 013 098 A1 1/2014

OTHER PUBLICATIONS

International Search Report issued for corresponding International Patent Application No. PCT/EP2015/000744 dated Aug. 7, 2015.

(Continued)

*Primary Examiner* — Jimmy T Nguyen
(74) *Attorney, Agent, or Firm* — Myers Wolin, LLC

(57) ABSTRACT

A machine press is provided in which at least one hermetically sealed hydraulic drive unit is switchable from a working mode, in which a base pressure above ambient pressure is continually exceeded, into a rest mode. To this end, in parallel with a pressure converter, to the high-pressure side of which a pressure store and a raising working chamber of a cylinder piston unit are connected, a bypass is provided, having a first blocking valve that is controllable by a control unit and, in its blocking position, blocks the through-flow direction from the high-pressure side of the pressure converter to the low-pressure side. Furthermore, the low-pressure side is connectable to a lowering working chamber via a second blocking valve controllable by the control unit. The pressure output of the hydraulic unit is connectable to the (Continued)

raising working chamber via a third blocking valve controllable by the control unit.

13 Claims, 1 Drawing Sheet

(52) U.S. Cl.
CPC ..... *F15B 2211/20515* (2013.01); *F15B 2211/20538* (2013.01); *F15B 2211/212* (2013.01); *F15B 2211/214* (2013.01); *F15B 2211/6306* (2013.01); *F15B 2211/6313* (2013.01); *F15B 2211/6651* (2013.01); *F15B 2211/6653* (2013.01)

(58) Field of Classification Search
CPC .. F15B 2211/20538; F15B 2211/20515; F15B 2211/212; F15B 2211/214; F15B 2211/6306; F15B 2211/6313; F15B 2211/6651; F15B 2211/6653
USPC ..... 100/269.01, 269.05, 48, 50
See application file for complete search history.

(56) References Cited

U.S. PATENT DOCUMENTS

| | | | | |
|---|---|---|---|---|
| 6,145,307 | A * | 11/2000 | Dantlgraber | B66F 9/22 60/327 |
| 6,240,758 | B1 * | 6/2001 | Nagakura | B21D 5/02 72/16.9 |
| 9,044,913 | B2 * | 6/2015 | Kurz | B30B 15/163 |
| 2003/0084794 | A1 * | 5/2003 | Koyama | B30B 15/16 100/269.01 |
| 2010/0212521 | A1 | 8/2010 | Resch et al. | |
| 2012/0272840 | A1 | 11/2012 | Kurz et al. | |
| 2015/0107466 | A1 | 4/2015 | Kurz et al. | |

OTHER PUBLICATIONS

English translation of the International Searching Authority Written Opinion issued for corresponding International Patent Application No. PCT/EP2015/000744, retrieved from the WIPO website on Jul. 19, 2017.

* cited by examiner

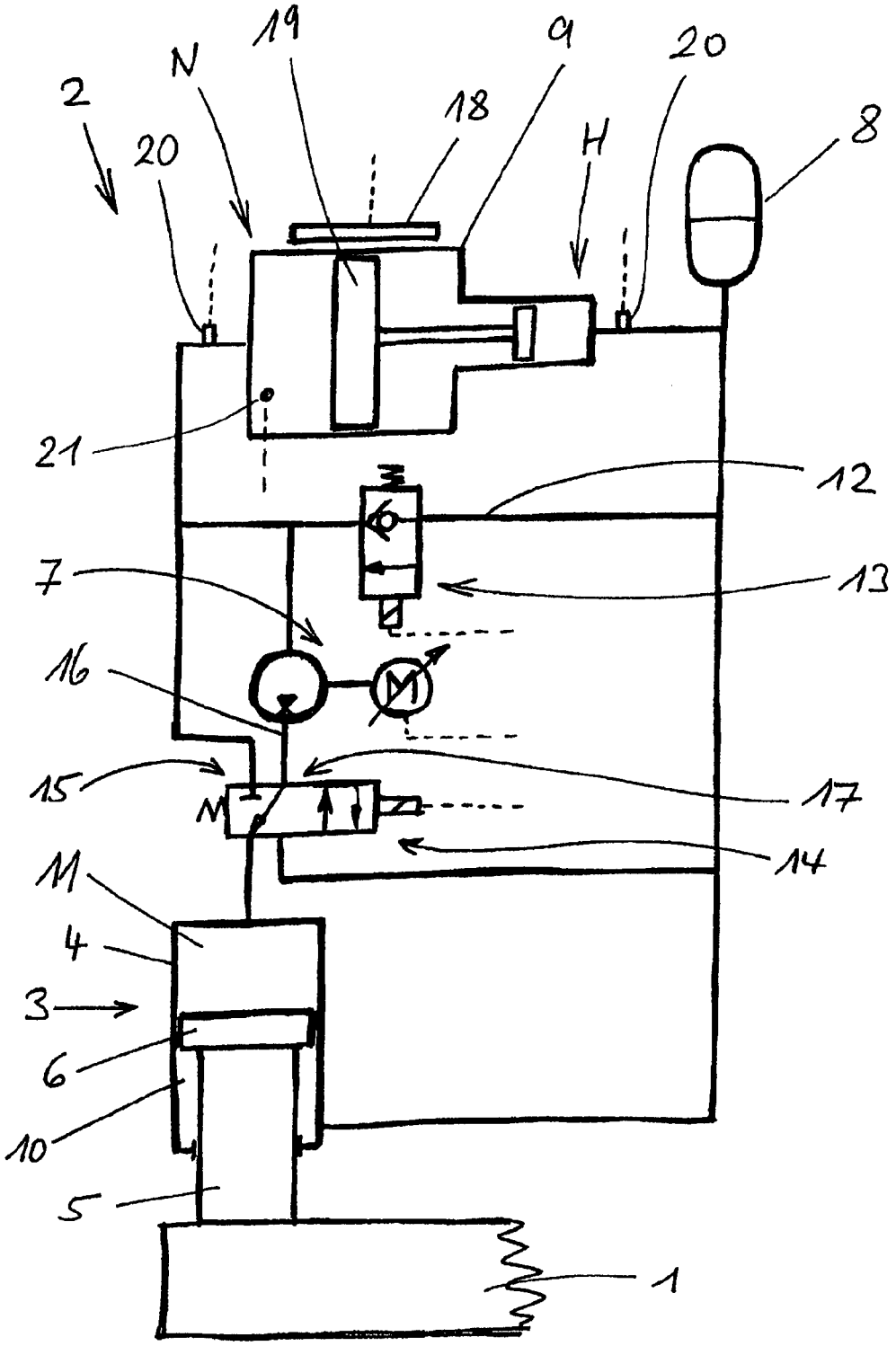
2
N
19
9
20
18
H
8
20
21
12
7
13
16
15
17
14
M
4
3
6
10
5
1

MACHINE PRESS

CROSS REFERENCE TO RELATED APPLICATIONS

This application is a continuation under 35 U.S.C. § 120 of International Application PCT/EP2015/000744, filed Apr. 9, 2015, which claims priority to German Application 102014005352.0, filed Apr. 11, 2014, the contents of each of which are incorporated by reference herein.

FIELD OF THE INVENTION

The present invention relates to a machine press with a lower die as well as an upper die that can be lowered and raised by means of a hydraulic linear drive, wherein the hydraulic linear drive comprises at least one hermetically sealed hydraulic drive unit and a control unit acting thereon.

BACKGROUND

Machine presses of the type indicated in the foregoing are known and in use in diverse versions and configurations. In particular, DE 102009052531 A1 and DE 102012013098 A1 belong to the pertinent prior art. Machine presses in which the hydraulic linear drive comprises at least one hermetically sealed hydraulic drive unit, as it does according to the two documents mentioned in the foregoing, are characterized by various practical advantages compared with such machine presses in which the hydraulic linear drive comprises at least one open hydraulic drive unit, i.e. a hydraulic drive unit with a tank that is vented to the atmosphere. In this respect it must be emphasized in particular that such machine presses are able to satisfy even those requirements that are imposed on clean-room technology. Incidentally, the fact that the at least one hydraulic drive unit of the hydraulic linear drive is hermetically sealed makes it possible to impress a particular base pressure on the hydraulic system, which in turn is advantageous in several respects. An appropriate initial pressure permits a reduction of the line cross sections with simultaneous enhancement of the dynamic response of the hydraulic drive unit, without resulting in the danger of cavitation. A machine press constructed with particularly compact hydraulic drive units can be inferred from DE 102012013098 A1 since, in the respective hydraulic drive unit, one and the same pressure accumulator on the one hand (directly) pressurizes the raising working chamber and on the other hand—via a pressure transformer—supplies an initial pressure in the hydraulic system.

SUMMARY

Starting from this prior art, the object of the present invention is to provide a machine press that is characterized by further increased operating capability as well as greater operating safety.

The object specified in the foregoing is achieved by the machine press specified in claim 1. In contrast to the machine press according to DE 102012013098 A1 and in comparison therewith, the machine press according to the present invention is therefore characterized in that the at least one hydraulic drive unit can be switched from a working mode, during which a base pressure higher than the ambient pressure is exceeded constantly and everywhere within the at least one hydraulic drive unit, to an idle mode, for which purpose a bypass having a first stop valve, which can be controlled by the control unit and in its blocking position blocks at least the flow direction from the high-pressure side of the pressure transformer to its low-pressure side, is provided in parallel with the pressure transformer, and furthermore the low-pressure side of the pressure transformer can be placed in communication with the lowering working chamber via a second stop valve that can be controlled by the control unit, and the pressure outlet of the hydraulic assembly can be placed in communication with the raising working chamber via a third stop valve that can be controlled by the control unit. Whereas in the machine press according to DE 102012013098 A1 the upper die—via the pressure accumulator connected to the raising working chamber and pressurizing it constantly—is initially preloaded in the direction of the upper dead point, in the sense that the upper die always occupies its maximally raised position without active pressurization of the lowering working chamber by the hydraulic assembly, it is possible in the machine press according to the present invention to switch between two modes of operation, namely between, on the one hand, a working mode, in which the machine press functions substantially in a manner corresponding to that according to the said prior art and, on the other hand, an idle mode, in which the upper die occupies a maximally lowered position, typically defined by stops. Via appropriate activation, by the control unit, of the stop valves provided according to the invention, the bypass provided parallel to the pressure transformer is opened, as is the communication of the low-pressure side of the pressure transformer to the lowering working chamber. As a result of the area ratios of raising working chamber on the one hand and lowering working chamber on the other hand, the upper die can be moved downward in this way into its completely lowered position without starting the hydraulic assembly, while at the same time the piston of the pressure transformer occupies such a position in which—via the opened first stop valve in direct communication with the pressure accumulator—the volume of the low-pressure side of the pressure transformer is maximum. In this way the hydraulic cylinder-piston unit as well as the pressure transformers "swallow" hydraulic fluid to an extent that is not the case in working mode. If the pressure accumulator is matched appropriately to the geometry of the pressure transformer and of the at least one hydraulic cylinder-piston unit, the hydraulic cylinder-piston unit and the pressure transformer in idle mode swallow so much hydraulic fluid that the buffer volume of the pressure accumulator is exhausted. If the pressure accumulator is constructed as a bladder accumulator, its membrane in this case bears on the connecting ports and seals them, with the consequence that the pressure in the system is no longer determined by the gas pressure in the pressure accumulator. The system pressure drops abruptly; and the system is relieved. Hereby a substantial reduction of the danger of leaks—during stoppage times—can be achieved. In the sense of clearly improved operating safety it must further be emphasized that the upper die—in its maximally lowered position—can be braced on mechanical stops during stoppage times; in this way tilting of the upper die, which in known machine presses of the type mentioned in the introduction cannot be ruled out—because of unilateral or uneven leaks within the two drive units—with sufficient safety during a possible prolonged stoppage time, can be prevented with certainty. Furthermore, it must be mentioned as an advantage relevant for practice that the overall height of the machine press in its idle mode (which can be maintained without energy consumption) is minimal, which is of considerable importance, especially during transportation and installation of the machine press. In contrast, in the machine press according to DE 102012013098 A1, the upper die can be moved only actively—i.e. with pressurization of the lowering working chamber by means of the hydraulic assembly—into its lowered position.

Instead of the lowering of the upper die on the basis of its own weight as described in the foregoing, solely by switching the first and second stop valves into their operating position corresponding to the idle mode, alternatively the upper die may also be moved actively into the lower dead point, i.e. by pressurization of the lowering working chamber from the hydraulic assembly, after which the first stop valve is opened, so that pressure equalization is established between the high-pressure side and the low-pressure side of the pressure transformer, and accordingly the piston of the pressure transformer is shifted entirely in the direction of the low-pressure side. Furthermore, in order to change the machine press—while completely lowering its upper die—from working mode into idle mode, with the first stop valve blocked, i.e. with the first stop valve non-energized or non-actuated, it is possible to bring about depressurization in the system via the pump, which is operated optionally in standard mode or in generator mode, for which purpose it is sufficient for the controllable second and the controllable third stop valves to be switched to their operating position corresponding to the idle mode. The aspects and advantages explained in the foregoing are valid in the same way for these variants.

To start operating the machine press, i.e. to change over from its idle mode to its working mode, the first stop valve is reset—by means of the control unit—in such a way that the bypass on the pressure transformer is blocked, at least in the flow direction from the high-pressure side of the pressure transformer to its low-pressure side. Simultaneously, the third stop valve is switched in such a way that the pressure outlet of the hydraulic assembly can be placed in communication with the raising working chamber (and the pressure accumulator). Because of startup of the hydraulic assembly, the raising working chamber is filled and the upper die is raised, while simultaneously hydraulic fluid escaping from the lowering working chamber, if it is not conveyed via the hydraulic assembly to the raising working chamber, is forced into the pressure accumulator. In machine presses equipped with two (or more) hydraulic decoupled drive units, the corresponding raising of the upper die takes place—during changeover of the machine from its idle mode to its working mode—by means of the two drive units in parallel, in synchronous, volume-controlled manner, so that tilting of the upper die while it is being correspondingly raised is prevented. Raising is ended when both drive units have reached their upper dead point, which is used as the reference point for the machine controller.

By using the stop valves provided according to the invention, it is therefore possible to match the two drive units to one another in such a way that identical pressure conditions act at their upper dead points in both systems. This is accomplished by influencing the position of the piston of the respective pressure transformer at the upper dead point of the upper die. This is possible because, under otherwise identical boundary conditions within the respective drive unit, the quantity of hydraulic fluid in the pressure accumulator and thus the initial pressure on the high-pressure side is greater the further the piston of the pressure transformer has been displaced in the direction of its low-pressure side. By matching the two drive units, individual volume/pressure changes caused by internal leaks, for example, can be sufficiently compensated that identical pressures nevertheless prevail in the reference position (upper dead point position) on the high-pressure side, and so the two raising working chambers are identically pressurized, whereby identical restoring forces are established on both sides of the upper die of the machine press. Such matching permits optimum synchronization of the two drive units, thus not only acting against the danger of tilting of the upper die but also leading to an optimum operating result.

Within the scope of the present invention, it is not only matching of the two drive units to one another, as explained in the foregoing, that is advantageous. To the contrary, calibration of the individual drive units to a specified pressure level is also achieved in particularly preferred manner. As explained in the foregoing, this is adjusted by specifying the position of the piston of the pressure transformer, and preferably in such a way, in fact, that the pressure in the pressure accumulators of the two drive units is sufficient to raise the upper die reliably and return it to the upper dead point at the end of the pressing process. On the other hand, the pressure in the pressure accumulators of the two drive units is preferably limited to this level. Thus the hydraulic assemblies do not have to work against an unnecessarily high return stroke raising force during pressing. This enhances the dynamic response of the pressing process as well as the performance of the machine press, is gentle on the latter and is nevertheless an aspect in particular of machine efficiency, since losses can be minimized in this way.

The foregoing calibration is also suitable in particular for compensating for the influence of different operating temperatures, since in this way an increase of the preload pressure on the pressure-accumulator side due to rising operation temperatures of the machine press is counteracted. Conversely, at particularly low operating temperatures (e.g. at ambient temperatures of <5° C.), the preload pressure can be actively raised (by shifting the piston of the pressure transformer in the direction of its low-pressure side). By the fact that the preload pressure can also be adjusted selectively to the ideal value (see above) at different operating temperatures, the drive unit does not have to be designed meticulously for the lowest temperatures, as far as the pressure accumulator and its filling are concerned. At operating temperatures above the minimum operating temperature during pressing, therefore, operation never takes place against an unnecessarily high back-pressure, with the already explained positive effects on machine efficiency.

Incidentally, it is not only in machine presses with several drive units that the calibration proves to be favorable for the explained reasons. To the contrary, it is obviously advantageous even in machine presses with only one drive unit, for reasons of machine efficiency, to be able to specify optimum conditions for the respective operating situation. By virtue of the calibration, an optimum operating condition of the machine press can be established at any time.

With reference to the options for calibration and/or hydraulic matching of several drive units explained in the foregoing, it is particularly preferred to allocate, to the at least one drive unit, at least one pressure transducer, the measured values of which can be conveyed to the control unit. In machine presses with several (hydraulically decoupled) drive units, preferably at least one such pressure transducer is allocated to each drive unit. Such pressure transducers can be disposed in particular on the two pressure transformers, namely on their respective high-pressure side, which is in communication with the pressure accumulator, since the hydraulic pressure, which is present on the high-pressure side and which acts constantly on the raising working chamber (see above), is of particular interest for the hydraulic matching of the two drive units.

With pressure transducers provided on the low-pressure side on the pressure transformers, the pressure on the high-pressure side can be determined by the pressure ratio—defined by the geometry of the pressure transformer—between low-pressure side and high-pressure side. The hydraulic pressure may also be inferred from the torque to be delivered by the motors of the hydraulic assemblies; in this case, there is no need for specific pressure transducers. According to yet another preferred improvement, displacement transducers, which sense the position of the respective piston, are allocated to the pressure transformers of the two drive units. The position signals representing the position of the pistons of the pressure transformers are also connected to the machine controller. The position of the pistons of the pressure transformers at the upper dead point is monitored, among other reasons to ensure that adequate piston stroke is available for the supply of hydraulic fluid (to the low-pressure side of the pressure transformer) for feeding the associated hydraulic assembly during pressing.

Whereas it is absolutely taken into consideration within the scope of the present invention that various cylinder-piston units can be used to raise and lower the upper die, it proves advantageous—especially from viewpoints of the smallest possible installation space or space requirement for the at least one hydraulic drive unit—that the or each hydraulic drive unit has at least one double-acting hydraulic cylinder-piston unit, which comes to bear during both raising and lowering of the upper die. Given suitable dimensioning and structural geometry, the or each hydraulic drive unit has—and this is regarded as particularly advantageous—exactly one (single) double-acting hydraulic cylinder-piston unit, which comprises both the raising working chamber and the lowering working chamber.

According to another preferred improvement of the present invention, in the interests of the least complex possible apparatus and control system and also of the smallest possible overall space requirement, the second and the third stop valves form a unit comprising a mode-of-operation selector coupled with a valve in such a way that, in a first valve position (working mode), the pressure outlet of the hydraulic assembly is in communication with the lowering working chamber and the communication of the lowering working chamber with the low-pressure side of the pressure transformer is interrupted, whereas in a second valve position (idle mode), the pressure outlet of the hydraulic assembly is in communication with the raising working chamber, as is the lowering working chamber with the low-pressure side of the pressure transformer. Particularly preferably, such a unit comprising a mode-of-operation selector and a valve includes a multi-way valve. Incidentally, all stop valves provided according to the invention are constructed particularly preferably as proportional valves, in order to permit controlled, gradual lowering of the upper die into its idle position.

Incidentally, in the unit comprising a mode-of-operation selector and valve as mentioned in the foregoing, it is possible according to yet another preferred improvement of the invention to integrate the first stop valve also, in such a way that the bypass (on the pressure transformer) is opened in idle mode while in working mode it is blocked at least in the flow direction from the high-pressure side of the pressure transformer to its low-pressure side. In the flow direction from the low-pressure side to the high-pressure side of the pressure transformer, however, flow is possible—by implementing a non-return function—even in the "blocking position" of the first stop valve.

In implementation of the present invention, the hydraulic drive unit works effectively (or the hydraulic drive units work effectively) with (respectively) one non-reversible hydraulic assembly. This is interesting and attractive from the economic perspective.

Diverse aspects among those explained in the foregoing, such as they are characteristic of the inventive machine press, can also be used advantageously for other applications of correspondingly constructed hydraulic linear drives.

It has already been explained hereinabove that the machine press may be changed over if necessary from the working mode into the idle mode even if the first stop valve is blocked, in which case pressure equalization in the system takes place via the pump of the hydraulic assembly instead of via the bypass present on the pressure transformer (when the second and third stop valves provided according to the invention are in appropriate operating position). In this sense it may be conceivable, in the inventive machine press, to eliminate entirely the controllable first stop valve disposed in the bypass on the pressure transformer and instead to leave there a non-return valve, which blocks in the direction from the high-pressure side of the pressure transformer to its low-pressure side. In this way, even without the controllable first stop valve, it is possible not only to change the machine press over from the working mode into the idle mode as explained, but conversely also to change the machine press over from the idle mode into the working mode, including the calibration of the drive unit as described in detail in the foregoing. With suitable dimensioning of the pressure transformer, to the effect that its volume available at most on the low-pressure side in idle mode of the machine press is not (yet) completely utilized, but instead some capacity still exists for receiving—during raising of the upper die—hydraulic fluid forced out of the lowering working chamber, it is even possible to dispense entirely with the bypass on the pressure transformer, without leading to impairment of the mode of operation of the machine press as explained in the foregoing (including the possibility of calibrating the drive units).

BRIEF DESCRIPTION OF THE DRAWING

The present invention will be explained in more detail hereinafter on the basis of a preferred exemplary embodiment illustrated (schematically) in FIG. 1. This drawing illustrates one of the two hydraulic drive units acting independently on an upper die of an inventive machine press. Incidentally, an illustration and corresponding explanation of the machine press will not be presented, because it is not pertinent for understanding of the present invention and because the present invention can be implemented in connection with any desired machine presses known as such from the prior art (e.g. DE 102009052531 A1 and DE 102012013098 A1, the complete disclosure content of which is made subject matter of the present disclosure by reference).

DETAILED DESCRIPTION OF THE PREFERRED EMBODIMENTS

The machine press illustrated in the drawing in what is the definitive detail section here (see above) comprises a lower die and an upper die 1 that can be lowered and raised by means of a hydraulic linear drive. This hydraulic linear drive comprises two hermetically sealed hydraulic cylinder units 2 acting on upper die 1 and a control unit acting on them.

Each hydraulic drive unit 2 comprises a double-acting hydraulic cylinder-piston unit 3 with a cylinder 4 and a piston 6 connected to upper die 1 via a piston rod 5, a hydraulic assembly 7, a pressure accumulator 8 and a pressure transformer 9. Piston 6 separates the raising working chamber 10 from the lowering working chamber 11. In working mode, drive unit 2 operates as can be inferred from DE 102012013098 A1. In particular, pressure is constantly admitted to raising working chamber 10 via pressure accumulator 8 and, in fact, to such a pressure level that upper die 1 is preloaded in its upper dead point. The lowering movement is achieved by pressurizing lowering working chamber 11 by hydraulic assembly 7. Via pressure transformer 9, which is connected on the high-pressure side to pressure accumulator 8, the system is constantly pressurized with an initial pressure; thus a base pressure that at least exceeds the ambient pressure prevails constantly and everywhere in the system during working mode.

The drive unit is illustrated with a single lowering working chamber 11. Obviously, however, this may also be split—with the advantages that can be inferred from DE 102012013098 A1—into a first working sub-chamber, which is used for (rapid) lowering of upper die 1 in rapid traverse, and a second working sub-chamber, which—together with the first working sub-chamber—is used for (slow) lowering of upper die 1 in pressing operation. In this case the second working sub-chamber is in communication with low-pressure side N of pressure transformer 9 via a feeder valve (see DE 102012013098 A1).

In contrast to the situation in the prior art, hydraulic drive unit 2 illustrated in the drawing can be switched according to the invention from the working mode into an idle mode. For this purpose, a bypass 12 containing a first stop valve 13 is provided in parallel with pressure transformer 9. This is constructed as a proportional 2/2-way valve with a blocking position, in which the flow direction from high-pressure side H of pressure transformer 9 to its low-pressure side N is blocked (via a non-return functionality) and a passing position, in which high-pressure side H and low-pressure side N of pressure transformer 9 are short-circuited. First stop valve 13 is constructed as a solenoid valve, which can be controlled by the control unit.

Also provided is a unit 14 comprising a mode-of-operating selector and valve, which is constructed as a proportional 4/2-way valve and unites two stop-valve functionalities in itself. And, in fact, low-pressure side N of pressure transformer 9 can be placed in communication with lowering working chamber 11 via a second stop valve 15, which can be controlled by the control unit; and pressure outlet 16 of the (non-reversible) hydraulic assembly 7 can be placed in communication with raising working chamber 10 (as well as pressure accumulator 8) via a third stop valve 17, which likewise can be controlled by the control unit. By virtue of structural and functional integration of second stop valve 15 and third stop valve 17 into unit 14 comprising a mode-of-operation selector and valve, these two stop valves are actuated in coupled relationship and, in fact, in such a way that, in a first valve position (working mode) shown in the drawing, pressure outlet 16 of hydraulic assembly 7 is in communication with lowering working chamber 11 and the communication of lowering working chamber 11 with low-pressure side N of pressure transformer 9 is interrupted, whereas, in a second valve position (idle mode), pressure outlet 16 of hydraulic assembly 7 is in communication with raising working chamber 10, as is lowering working chamber 11 with low-pressure side N of pressure transformer 9. If first stop valve 13 is switched to its passing position in idle mode, pressure equalization exists both between high-pressure side H and low-pressure side N of pressure transformer 9 and between raising working chamber 10 and lowering working chamber 11 of cylinder-piston unit 3. Upper die 1 is lowered into an idle position, in which it is braced on stops (or is held there once it has been moved actively into the lowered position). Freely moving piston 19 of pressure transformer 9 moves so far in the direction of high-pressure side H that low-pressure side N receives all hydraulic fluid from pressure accumulator 8. When the membrane of pressure accumulator 8 constructed as bladder accumulator then reaches the stop, the rest of the system is suddenly depressurized.

In order to change the machine press—while raising upper die 1 into its upper end position (determined by the upper dead point of piston 6)—over from idle mode into working mode, hydraulic assembly 7—with unchanged operating position of unit 14 comprising mode-of-operation selector and valve, but with first stop valve 13 switched to the non-return blocking position—is started up. Raising working chamber 10 is pressurized from hydraulic assembly 7 and gradually filled, in which case the hydraulic fluid forced out of lowering working chamber 11 in the process, i.e. during the raising of upper die 1, passes through bypass 12 into pressure accumulator 8, to the extent that it is not conveyed via hydraulic assembly 7 to raising working chamber 10. Beginning from the end of raising of upper die 1, i.e. when pistons 6 reach their upper dead point position, hydraulic assemblies 7 are fed from the respective low-pressure side of the associated pressure transformer 9. The hydraulic fluid transported from hydraulic assembly 7, to the extent it is not conveyed to the expanding high-pressure side H of the pressure transformer in a manner corresponding to the movement of piston 19 of pressure transducer 9, is forced into pressure accumulator 8. The corresponding filling of pressure accumulator 8—with continuing movement of piston 19 of pressure transformer 9 in the direction of its low-pressure side N—takes place until the pressure level predetermined by the machine controller (i.e. especially the nominal pressure on high-pressure side H) is attained ("calibration"). Now the two stop valves 15 and 17 are also reversed by the controller, so that they again occupy their operating position illustrated in the drawing and corresponding to the working mode of the machine press.

As long as the attainment of the predetermined pressure level on the high-pressure side is not being derived from the torque of the motor of hydraulic assembly 7, a pressure measurement takes place. In this way high-pressure side H and/or low-pressure side N of pressure transducers 9 of the two drive units 2 can be assigned to pressure transducers 20, the measured values of which can be conveyed to the control unit. On the basis of these measured values of pressure, and as an alternative to the preferred derivation of the pressure level from the motor torque (if applicable including a torque limitation that can be predetermined by the machine controller), the two drive units 2 can be calibrated as well as hydraulically matched as explained in the foregoing, and so on this basis the same and ideal pressure level is present on the high-pressure side at the upper dead point of both drive units 2.

The sequence described in the foregoing for the changeover from the idle mode into the working mode results directly from the fact that the piston-area ratio between low-pressure side N and high-pressure side H of the pressure transducer is greater by a multiple (i.e. by a factor between 4 and 8) than the piston-area ratio between lowering working chamber 11 and raising working chamber 10. A pressure step-down ratio of the pressure transformer between 50:1 and 100:1 and a piston-area ratio of lowering and raising working chambers between 8:1 and 20:1 have proven particularly suitable for a typical use. For other geometries, the sequence could be achieved if necessary by an auxiliary valve, which hydraulically blocks the pressure transformer until upper die 1 has been completely raised.

For the raising of upper die 1 from its idle position (see above) during the changeover from the idle mode into the working mode of the machine press, the two drive units 2 are operated in parallel, synchronously volume-controlled manner. Hydraulic assemblies 7 are operated with identical transport rates, by virtue of appropriate activation of their motors M by the control unit. As a result, no danger of tilting exists.

For monitoring of the system, displacement transducers 18, which sense the position of piston 19 of the corresponding pressure transformer 9, are assigned to pressure transformers 9 of the two drive units 2. Since, as explained hereinabove, a correlation exists between the position of piston 19 of pressure transformer 9 and the pressure on the high-pressure side at the top dead point position of piston 6 of corresponding drive unit 2, a particular pressure level on the high-pressure side can also be inferred from the position of piston 19 of pressure transformer 9, although temperature influences do exist in this respect. In order to allow for these in the machine controller, it is possible, as illustrated, for example, on low-pressure side N of pressure transformer 9, to provide temperature sensors 21, preferably distributed at various positions within the system.

What is claimed is:

1. A machine press comprising:

a lower die as well as an upper die (1) that can be lowered and raised by means of a hydraulic linear drive, wherein the hydraulic linear drive comprises at least one hermetically sealed hydraulic drive unit (2) and a control unit acting thereon and, in a working mode, a base pressure higher than an ambient pressure is exceeded constantly and everywhere within the hydraulic drive unit (2), wherein:

the hydraulic drive unit comprises at least one hydraulic cylinder-piston unit (3) acting on the upper die (1), a hydraulic assembly (7), a pressure accumulator (8) and a pressure transformer (9);

the at least one hydraulic cylinder-piston unit (3) comprises at least one lowering working chamber (11) as well as at least one raising working chamber (10);

the at least one raising working chamber (10) as well as a high-pressure side (H) of the pressure transformer (9) is connected to the pressure accumulator (8);

the hydraulic assembly (7) can be fed from a low-pressure side (N) of the pressure transformer (9) in order to pressurize the at least one lowering working chamber (11);

the at least one hydraulic drive unit (2) can be switched from a working mode into an idle mode;

for this purpose a bypass (12) having a first stop valve (13), which can be controlled by the control unit and in its blocking position blocks at least a flow direction from the high-pressure side (H) of the pressure transformer (9) to the low-pressure side (N), is provided in parallel with the pressure transformer (9);

furthermore the low-pressure side (N) of the pressure transformer (9) can be placed in communication with the lowering working chamber (11) via a second stop valve (15) that can be controlled by the control unit;

and a pressure outlet (16) of the hydraulic assembly (7) can be placed in communication with the raising working chamber (10) via a third stop valve (17) that can be controlled by the control unit.

2. The machine press of claim 1, wherein the at least one hydraulic drive unit (2) has at least one double-acting hydraulic cylinder-piston unit (3).

3. The machine press of claim 2, wherein the at least one hydraulic drive unit (2) has exactly one double-acting hydraulic cylinder-piston unit (3).

4. The machine press of claim 1, wherein the second stop valve (15) and the third stop valve (17) form a unit (14) comprising a mode-of-operation selector coupled with a valve in such a way that, in a first valve position (working mode), the pressure outlet (16) of the hydraulic assembly (7) is in communication with the lowering working chamber (11) and a communication of the lowering working chamber (11) with the low-pressure side (N) of the pressure transformer (9) is interrupted, and in a second valve position (idle mode), the pressure outlet (16) of the hydraulic assembly (7) is in communication with the raising working chamber (10), as is the lowering working chamber (11) with the low-pressure side (N) of the pressure transformer (9).

5. The machine press of claim 4, wherein the first stop valve (13) is integrated into the unit (14) comprising a mode-of-operation selector and valve in such a way that the bypass (12) is opened in idle mode and in working mode it is blocked at least in the flow direction from the high-pressure side (H) of the pressure transformer (9) to the low-pressure side (N).

6. The machine press of claim 1, wherein the hydraulic assembly (7) is of non-reversible construction.

7. The machine press of claim 1, wherein the hydraulic linear drive comprises two hydraulically decoupled drive units (2) of identical construction acting in parallel on the upper die.

8. The machine press of claim 7, wherein the two drive units (2) can be moved in parallel, synchronously volume-controlled manner to an upper dead point during a transition from the idle mode into the working mode.

9. The machine press of claim 1, wherein a calibration routine can be executed on the at least one drive unit (2) for adjustment of a pressure level present at a reference point in the pressure accumulator (8).

10. The machine press of claim 9, wherein a displacement transducer (18), which senses a position of a piston (19) of the associated pressure transformer (9), is allocated to the pressure transformer (9) of the at least one drive unit (2).

11. The machine press of claim 1, wherein at least one pressure transducer (20), a measured values of which can be conveyed to the control unit, is allocated to the pressure transformer (9) of the at least one drive unit (2).

12. The machine press of claim 1, wherein a torque of a motor of the hydraulic assembly (7) is evaluated in the machine controller as an indicator for the hydraulic pressure in the pressure accumulator (8).

13. A hydraulic linear drive for moving a driven part along a working axis in a first movement direction and a second movement direction opposite to the first movement direction, comprising a hermetically sealed hydraulic drive unit (2), in which, in a working mode, a base pressure higher than an ambient pressure is exceeded constantly and everywhere, wherein:

the hydraulic drive unit (2) comprises at least one hydraulic cylinder-piston unit (3), a hydraulic assembly (7), a pressure accumulator (8) and a pressure transformer (9);

the at least one hydraulic cylinder-piston unit (3) comprises at least one first working chamber (10) that is active with respect to the first movement direction as well as at least one second working chamber (11) that is active with respect to the second movement direction;

the at least one first working chamber (10) as well as a high-pressure side (H) of the pressure transformer (9) is connected to the pressure accumulator (8);

the hydraulic assembly (7) can be fed from a low-pressure side (N) of the pressure transformer (9) in order to pressurize the at least one second working chamber (11);

the at least one hydraulic drive unit (2) can be switched from a working mode into an idle mode;

for this purpose a bypass (12) having a first stop valve (13), which can be controlled by the control unit and in its blocking position blocks at least a flow direction from the high-pressure side (H) of the pressure transformer (9) to the low-pressure side (N), is provided in parallel with the pressure transformer (9);

furthermore the low-pressure side (N) of the pressure transformer (9) can be placed in communication with the second working chamber (11) via a second stop valve (15) that can be controlled by the control unit;

and a pressure outlet (16) of the hydraulic assembly (7) can be placed in communication with the first working chamber (10) via a third stop valve (17) that can be controlled by the control unit.

* * * * *